US006237615B1

(12) United States Patent
Carso et al.

(10) Patent No.: US 6,237,615 B1
(45) Date of Patent: May 29, 2001

(54) DISPOSABLE UMBRELLA

(76) Inventors: Barbara A. Carso; Gary G. Truchan, both of 1265 Norberry Ct., Cranberry Twp., PA (US) 16066

( * ) Notice: Subject to any disclaimer, the term of this patent is extended or adjusted under 35 U.S.C. 154(b) by 0 days.

(21) Appl. No.: 09/479,019

(22) Filed: Jan. 7, 2000

(51) Int. Cl.[7] ..... A45B 19/00

(52) U.S. Cl. ..... 135/19.5; 135/20.2; 135/910

(58) Field of Search ..... 135/19.5, 20.1, 135/20.2, 20.3, 28, 32–392, 25.34, 33.2, 33.41, 910

(56) References Cited

U.S. PATENT DOCUMENTS

| | | | | |
|---|---|---|---|---|
| D. 342,827 | | 1/1994 | Wurflingsdobler | D3/6 |
| 1,924,426 | * | 8/1933 | Williams | 135/19.5 X |
| 2,671,458 | * | 3/1954 | Goldstein et al. | 135/19.5 |
| 3,281,586 | * | 10/1966 | Gonzalez | 135/910 |
| 3,466,221 | * | 10/1969 | Truitt | 135/910 |
| 3,765,433 | | 10/1973 | Futamura et al. | 135/20 |
| 4,062,369 | * | 12/1977 | Hermanson | 135/19.5 |
| 4,114,634 | | 9/1978 | Hermanson | 135/19.5 |
| 4,783,856 | | 11/1988 | Bouwens et al. | 2/87 |
| 4,821,756 | | 4/1989 | England | 135/19.5 |
| 5,069,237 | * | 12/1991 | Flanagan | 135/19.5 |
| 5,725,004 | * | 3/1998 | Moulder | 135/20.2 |
| 5,964,234 | * | 10/1999 | Bailly et al. | 135/19.5 |

FOREIGN PATENT DOCUMENTS

| | | | | |
|---|---|---|---|---|
| 1342084 | * | 9/1963 | (FR) | 135/19.5 |
| WO 87/01262 | | 3/1987 | (WO) . | |

* cited by examiner

*Primary Examiner*—Richard Chllcot

(57) ABSTRACT

An umbrella having a molded handle, a translucent telescopic center shaft, and a plastic dome. When opened the umbrellas's dome is supported by a series of flexible plastic spokes with living hinges. The plastic dome is attached to the spokes by heat welding to supporting tabs. The section of the telescoping shaft nearest the handle has a cut out section for insertion of a "lightstick" so that the user can activate the chemically based glowstick and insert it into the cutout section and also remove and replace it as needed.

5 Claims, 2 Drawing Sheets

FIG 3
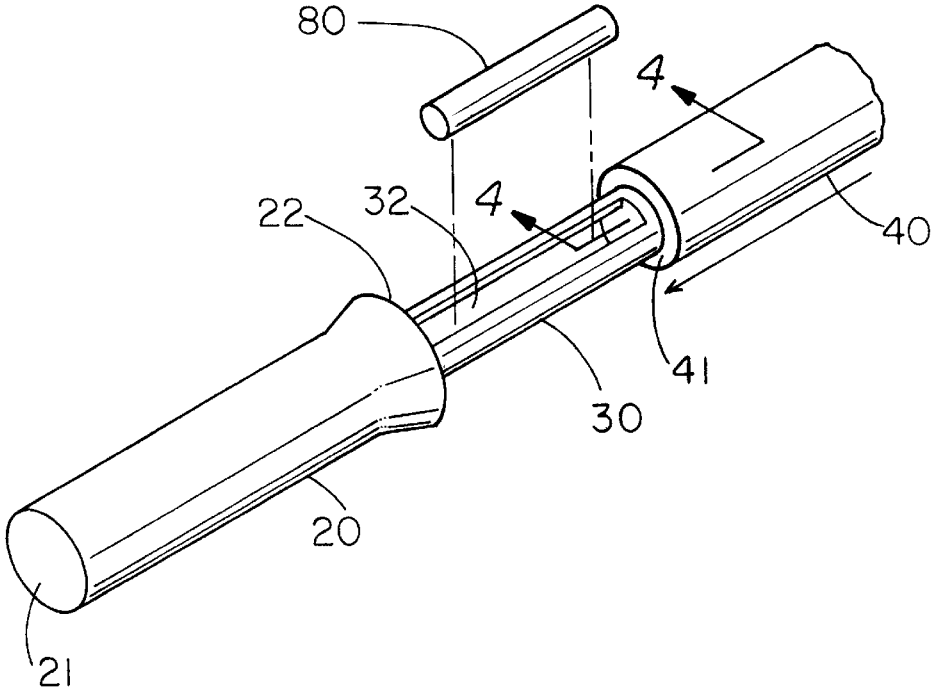
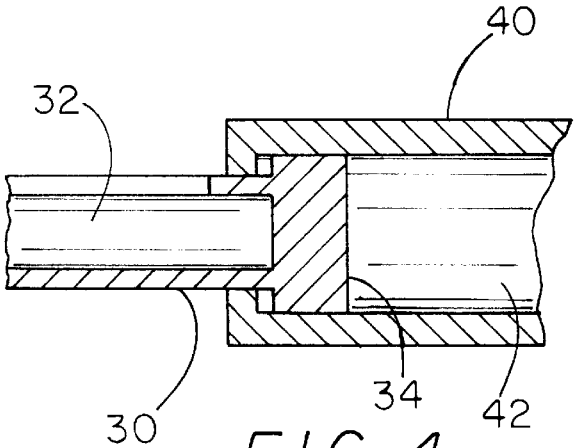
FIG 4
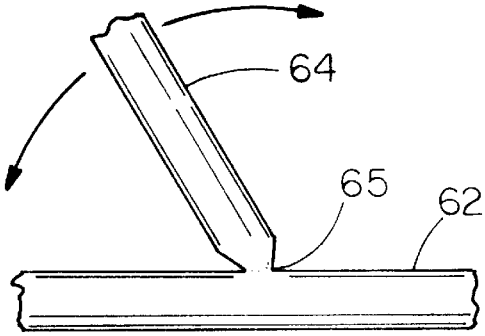
FIG 5

DISPOSABLE UMBRELLA

BACKGROUND OF THE INVENTION

1. Field of the Invention

The present invention relates to a disposable umbrella and in particular to a disposable umbrella with chemical light.

2. Description of the Prior Art

Conventional umbrellas require the mechanical assembly of many parts made of a wide variety of materials. Such multiplicity of parts and materials makes the umbrella expensive. A desired alternative is a disposable umbrella of simple design and inexpensive manufacture. U.S. Pat. No. 4,821,756 discloses a disposable umbrella with supporting struts joined by living hinges which when folded is contained with a protective tube. What is needed beyond the prior art is an even simpler design. A second need beyond the prior art is for an umbrella with an inexpensive means of illumination.

SUMMARY OF THE INVENTION

The present invention meets the needs and solves the problems identified above by providing an umbrella having a molded handle, a translucent telescopic center shaft, and a plastic dome. When opened, the umbrella's dome is supported by a series of flexible plastic spokes with living hinges. The plastic dome is attached to the spokes by heat welding to supporting tabs. The section of the telescoping shaft nearest the handle has a cut out section for insertion of a "lightstick" so that the user can activate the chemically based glowstick and insert it into the cut out section and also remove and replace it as needed.

The foregoing and other objects, features and advantages of the invention will be apparent from the following more particular description of a preferred embodiment of the invention, as illustrated in the accompanying drawings wherein like reference numbers represent like parts of the invention.

BRIEF DESCRIPTION OF THE DRAWINGS

FIG. 3 is a right side perspective view of the handle and lightstick compartment.

FIG. 4 is a cross sectional view along line 4—4 of FIG. 3.

FIG. 5 is a detail view of a living hinge.

DESCRIPTION OF PREFERRED EMBODIMENTS

Figure 1:
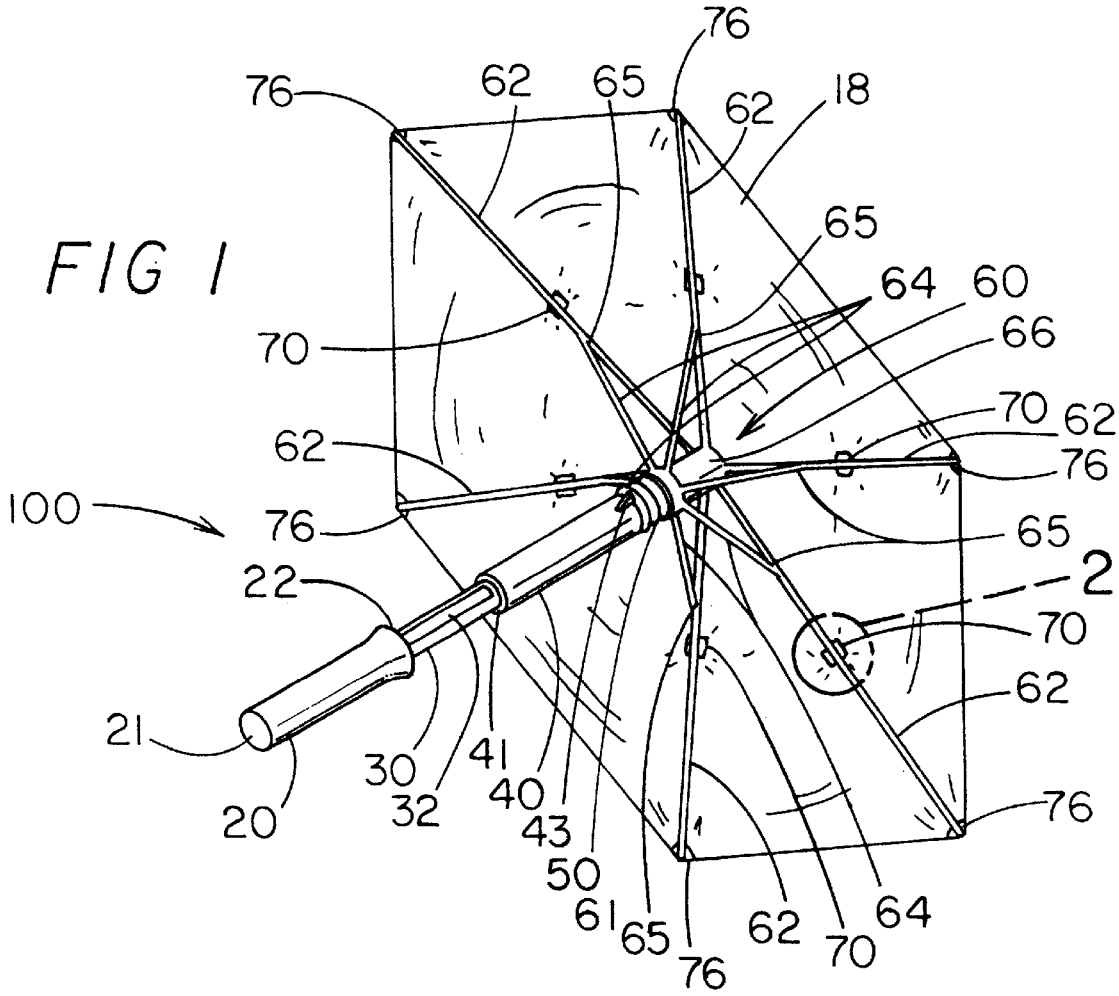
FIG. 1 is a side perspective of the deployed umbrella.

In FIG. 1, umbrella 100 has handle 20, shaft 30, slide 40, spring 50, ring 61, base 66 and dome 10. Handle 20 has handle bottom 21 and handle top 22. Handle 20 may be made of molded plastic and may be translucent or transparent. Handle 20 is flared at handle top 22 to facilitate seating of shaft 30 in umbrella 100's closed position (not shown). Shaft 30 is fixedly engaged to handle 20 and has compartment 32 for receiving a lightstick (not shown). The term lightstick as used herein means a commercially available chemically activated illumination device that glows for a period of time after the chemicals contained in the stick are activated. Compartment 32 may receive lightsticks up to six inches in length. In the preferred embodiment, shaft 30 is made of translucent or transparent material to increase the illumination when an activated lightstick is inserted in compartment 32. Slide 40 is slidingly engaged with shaft 30 so that slide 40 may cover compartment 32 in shaft 30 and seat slide first end 41 in handle top 22. Switch 43 is embedded in slide 40 so that it has a first position flush with the outer surface of slide 40 (not shown) and a second position raised and extending outward from slide 40 (shown). Spring 50, ring 61, spokes 62, ribs 64 and base 60 are all connected. Spring 50 and ring 61 are slidingly engaged on slide 40. When switch 43 is depressed, spring 50 and ring 61 can slide toward handle 20 bringing ribs 64 towards handle 20 and ribs 64 pull spokes 62 downward toward handle 20 until spokes 62 are nearly parallel to slide 40. Umbrella 100 is deployed in the reverse manner by grasping spring 50 and pushing spring 50 and ring 61 away from handle 20 until ring 61 and spring 50 have passed over switch 43. Passage of spring 50 and ring 61 over switch 43 is allowed by the triangular shape of switch 43 in the deployed position so that when ring 61 meets the sloping surface of the triangle of switch 43, switch 43 is depressed downward. When ring 61 and spring 50 have completed passage over switch 43 and have cleared the end of switch 43, switch 43 will pop up and the vertical end of the triangle will face spring 50. Spring 50 will exert pressure on switch 43 and on ring 61 which will keep tension in ribs 64 supporting spokes 62. Ribs 64 are hingedly engaged to ring 61 by a living hinge. By living hinge is meant that ribs 64 and ring 61 are made from a unitary piece of material where a cut is made at the juncture of the two parts to allow rotatable movement of the two parts in relation to one another. Ribs 64 are hingedly connected to spokes 62 and spokes 62 are hingedly connected to base 66. Base 66 and slide 40 are fixedly engaged and may be made of the same piece of material. In the preferred embodiment, base 66 and slide 40 have the same diameter and circumference but are made separately to facility assembly and insertion of switch 43. Persons skilled in the art are aware of a variety of means for connecting base 66 and slide 40. In the preferred embodiment, base 66 is glued to slide 40 after spring 50 and ring 61 are installed on slide 40. Dome 10 is made of plastic film that is stretched over the fully deployed spokes 62 and affixed to spokes 62 at end tabs 76 and at spoke tabs 70 by heat welding. Spokes may vary in length from 8 inches to 18 inches. Each spoke is approximately ⅛inch in diameter.

Figure 2:
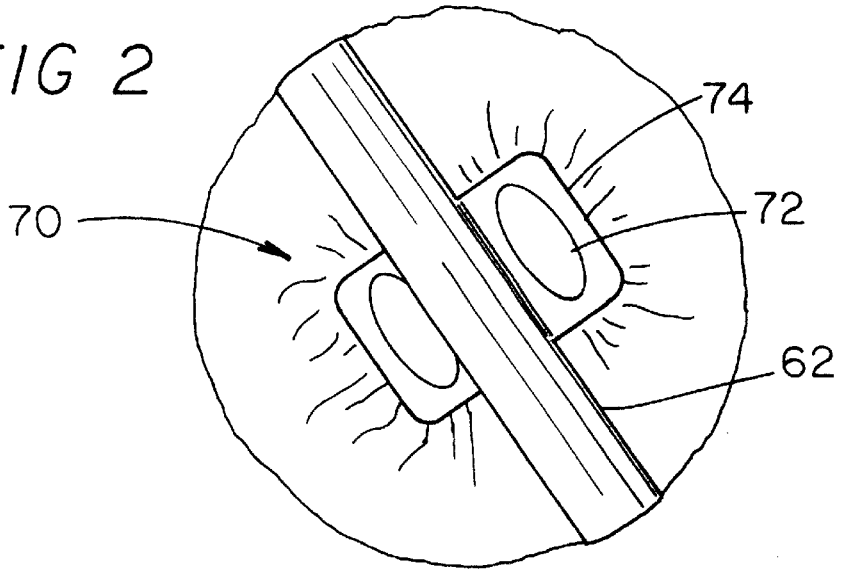
FIG. 2 is a detail view of the heat welding tabs.

FIG. 2 depicts a detail view of one spoke tab 70. All spoke tabs are the same. Spoke tab 70 is fixedly engaged to spoke 62 and contains spoke aperture 72. Spoke tab 70 may be molded in one piece to spoke 62 or spoke tab 70 may be affixed to spoke 62 by adhesive.

FIG. 3 depicts handle 20, shaft 30 and slide 40 with compartment 32 visible and lightstick 80 shown above compartment 32 and positioned for insertion into compartment 32. Slide 40 can be moved over shaft 30 to cover compartment 32.

FIG. 4 depicts a cross section along line 4—4 in FIG. 3. Shaft 30 can be seen entering slide 40 with shaft cap 34 slidingly engaged in slide interior 42. Shaft cap 34 prevents shaft 30 from being pulled out of slide 40.

FIG. 5 depicts living hinge 65 at the juncture of rib 64 and spoke 62. Approximately half of the plastic around rib 64 has been removed allowing rib 64 to flex and rotate about spoke 62.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

What is claimed:

1. An umbrella comprising:

a handle fixedly connected to a shaft, said shaft having a compartment;

a slide slidingly engaged to said shaft;

a spring slidingly engaged to said slide;

a ring sliding engaged to said slide;

a base fixedly engaged to said slide and hingedly connected to a plurality of spokes;

a plurality of ribs hingedly connected to said ring and to said spokes; and a dome fixedly engaged to said spokes.

2. The spokes of claim 1 further comprising a plurality of tabs wherein said dome is fixedly engaged to said tabs.

3. The apparatus of clalim 1 further comprising a lightstick insertable into said compartment.

4. The apparatus of claim 1 further comprising a plurality of living hinges.

5. An umbrella comprising:

a handle fixedly connected to a shaft, said shaft having a compartment;

a slide slidingly engaged to said shaft;

a spring slidingly engaged to said slide;

a ring slidingly engaged to said slide;

a base fixedly engaged to said slide and hingedly connected to a plurality of spokes;

a plurality of tabs fixedly engaged to said spokes and to said dome;

a plurality of ribs hingedly connected to said ring and to said spokes;

a dome fixedly engaged to said spokes; and a lightstick insertable into said compartment.

* * * * *

UNITED STATES PATENT AND TRADEMARK OFFICE

CERTIFICATE OF CORRECTION

PATENT NO. : 6,237,615 B1
DATED : May 29, 2001
INVENTOR(S) : Barbara A. Corso et al.

It is certified that error appears in the above-identified patent and that said Letters Patent is hereby corrected as shown below:

Title page,
Item [76], Inventors, "Barbara A. Carso," should read -- Barbara A. Corso --.

Signed and Sealed this

Twenty-fourth Day of December, 2002

JAMES E. ROGAN
*Director of the United States Patent and Trademark Office*